US005657738A

United States Patent [19]

Klundt

[11] Patent Number: 5,657,738

[45] Date of Patent: Aug. 19, 1997

[54] PROJECTILE TOY

[76] Inventor: Kalvin Klundt, 1113 West Highway 42, LaGrange, Ky. 40031

[21] Appl. No.: 726,835

[22] Filed: Oct. 8, 1996

[51] Int. Cl.[6] ..... F41B 7/02

[52] U.S. Cl. ..... 124/17; 124/20.1

[58] Field of Search ..... 124/17, 18, 20.1

[56] References Cited

U.S. PATENT DOCUMENTS

| | | | |
|---|---|---|---|
| 101,382 | 3/1870 | Robinson | 124/18 |
| 316,862 | 4/1885 | Armington | 124/21 |
| D. 372,749 | 8/1996 | Klundt | D21/203 |
| 1,626,892 | 5/1927 | Tidwell | 124/18 |
| 2,334,332 | 11/1943 | Johnson | 124/17 |
| 2,708,429 | 5/1955 | Tufts | 124/2 |
| 3,088,450 | 5/1963 | Clay | 124/26 |
| 3,286,392 | 11/1966 | Fortunato | 446/225 |
| 3,580,234 | 5/1971 | Guyer et al. | 124/21 |
| 3,590,518 | 7/1971 | LeBaron | 446/64 |
| 3,662,730 | 5/1972 | Feldman | 124/17 |
| 4,324,220 | 4/1982 | Joelson | 124/18 |
| 5,279,276 | 1/1994 | Nagel et al. | 124/20.1 |
| 5,579,749 | 12/1996 | Wilkinson | 124/17 |

*Primary Examiner*—John A. Ricci

*Attorney, Agent, or Firm*—Wheat, Camoriano, Smith & Beres, PLC

[57] ABSTRACT

A toy for propelling soft spherical projectiles includes a projectile of material such as foamed plastic, and a hand held launcher. A tubular elastic member is anchored to the projectile and extends through the projectile and out of a surface of the projectile a sufficient distance to allow a user to grasp and stretch the elastic member. The launcher includes a hand grip and a seat against which the projectile is positioned, and an opening to the rear of the seat through which the elastic member extends. After positioning the projectile on the seat, a user pulls the elastic member rearward to stretch, then releases it to propel the projectile forward. The projectile may include a strip of adhering material such as a hook and loop fastener; a target with a complementary adhering material may be mounted on a wall or the launcher.

11 Claims, 7 Drawing Sheets

PROJECTILE TOY

BACKGROUND OF THE INVENTION

This invention relates to a toy and, more particularly, to a toy that elastically propels a projectile of soft material.

Toys that elastically propel articles are well known as illustrated, for example, in U.S. Pat. No. 316,862 to Armington in which a spherical member is expelled from a tubular chamber by a spring actuated plunger. A toy gun using an attached elastic member to project a spherical member is described in U.S. Pat. No. 2,768,429 to Tufts. A toy rocket that is propelled with a spring pulled into compression by a flexible cord is depicted in U.S. Pat. No. 3,068,450 to Clay. Another rocket toy is described in U.S. Pat. No. 3,238,392 to Fortunato in which the end of an elastically propelled rocket is supplied with an inflated balloon as a "nose cone". U.S. Pat. No. 3,590,518 to LeBaron is typical of many toys in which the projectile is slung forward in sling slot fashion with an elastic band.

While there are many commercialized toy products and games in which soft objects made of foamed material are thrown between or at players or targets, there are few toys that project the soft objects, particularly with accuracy. It is therefore a primary object of the present invention to provide for a toy that propels soft objects with accuracy yet is simple to operate. It is still another object of the present invention to provide for a toy capable of projecting and catching soft objects. It is a further object of the present invention to provide for a target game including a toy that accurately projects soft objects toward a spaced target adapted to catch and retain such objects on impact. These and other objects will be met upon a reading of the description below along with the appended drawings.

SUMMARY OF THE INVENTION

The present invention realizes the above objects through a toy for the propelling of soft projectiles using an elastomeric propelling component. The toy comprises a hand held launcher and a projectile. The projectile has a projectile head of soft material defining a substantially spherical surface and a tubular elastic member of a predetermined length extending through the spherical surface and into the projectile a distance greater than the radius of the spherical surface, The elastic tubular member is attached at one end to the projectile head with a portion of the elastic tubular member extending away from the projectile head a distance sufficient for a user to grasp and stretch said elastic tubular member away from said attached one end, The launcher comprises a hand grip and a seat against which the projectile head is positioned, The launcher further defines an opening adjacent the hand grip through which the portion of the elastic tubular member extends.

DETAILED DESCRIPTION OF TEE PREFERRED EMBODIMENT

Figure 1:
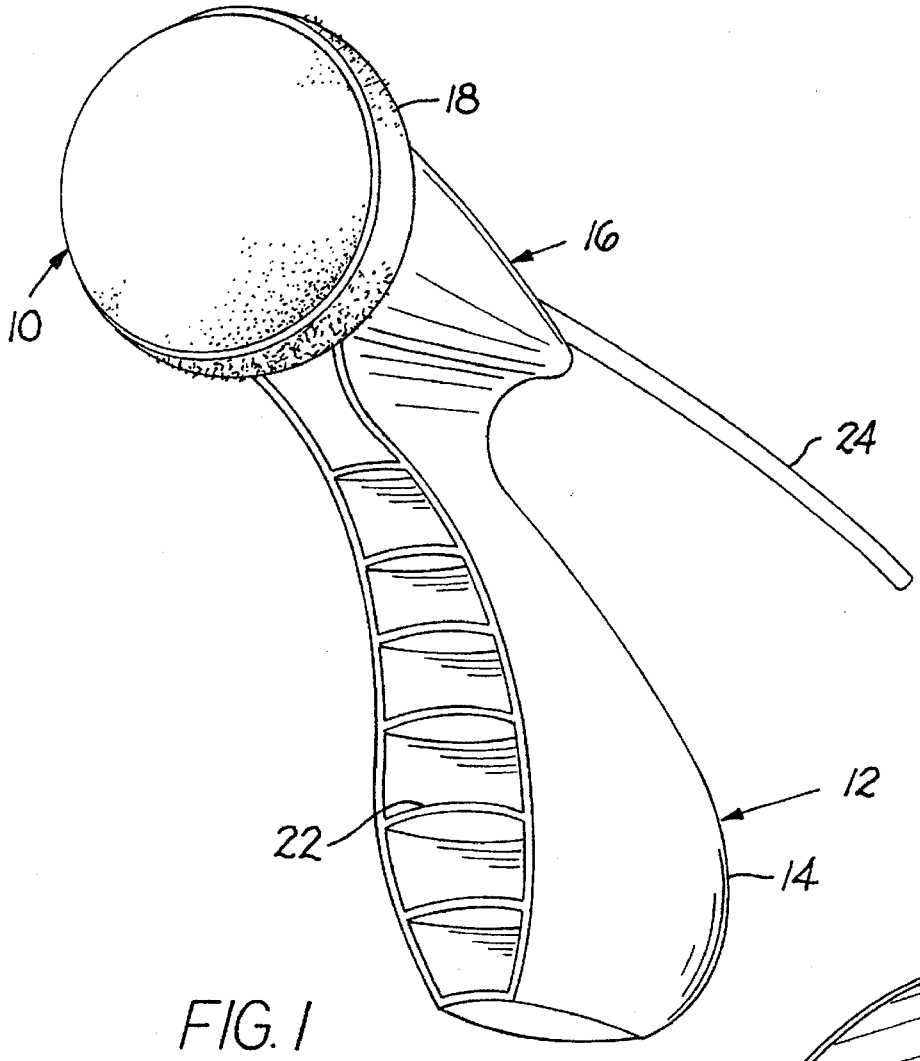
FIG. 1 is a perspective view of a toy showing the hand held launcher and spherical projectile with elastic band in position for being propelled.
Figure 2:
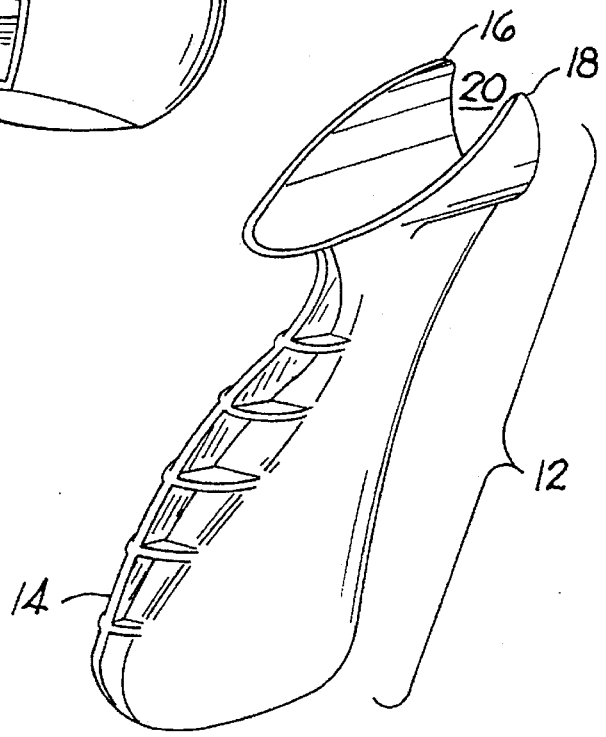
FIG. 2 is a perspective showing the hand held launcher without the projectile.
Figure 3:
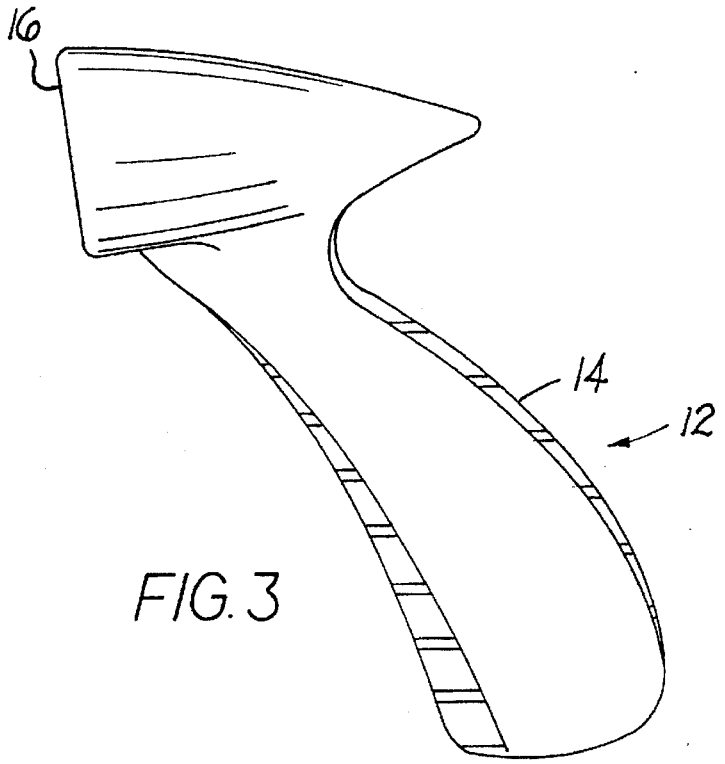
FIG. 3 is a side view of the launcher.
Figure 11:
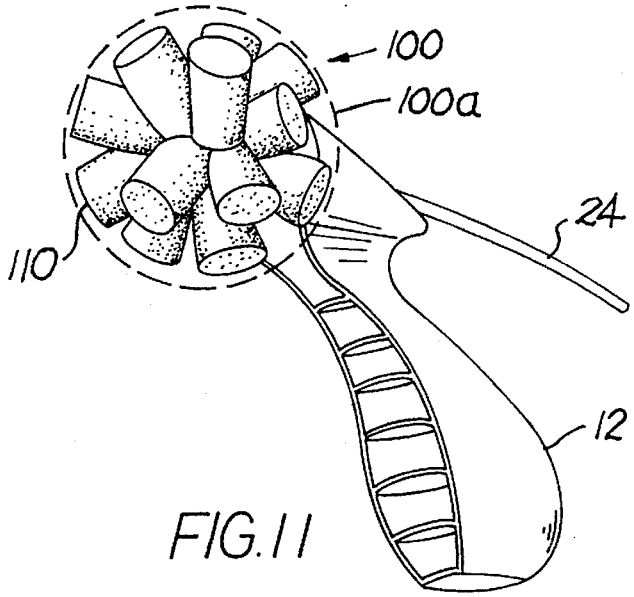
FIG. 11 is a perspective view of still another embodiment of the present invention in which the projectile comprises a plurality of cylindrically shaped objects tied together about the centers thereof.
Figure 12:
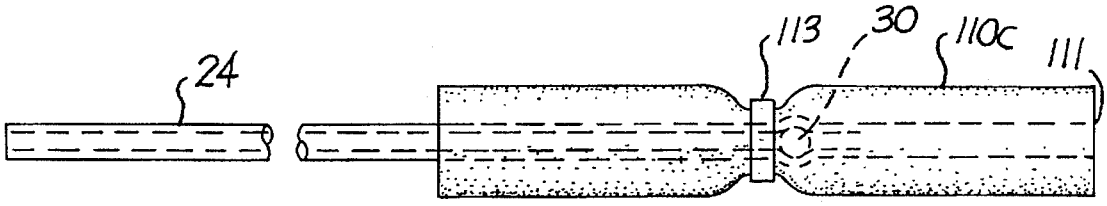
FIG. 12 is a side view a central cylindrical object of the projectile of FIG. 11 to which the elastic band is attached.

The present invention contemplates the use of various constructions of projectiles with the commonality being that each of the projectiles has a "substantially spherical surface". For purposes of this description, a spherical surface is defined as a surface that circumscribes and is essentially tangent or congruous to the element or elements making up the projectile. Thus, the spherical projectile 10 as illustrated in FIG. 1 and the projectile 100 comprising a plurality of separate elements 110 as illustrated in FIG. 11 are each defined as having a substantially spherical surface. The dashed curve 100*a* represents a spherical surface in FIG. 11 that is essentially tangent to the ends of the various projectile elements 110.

Figure 4:
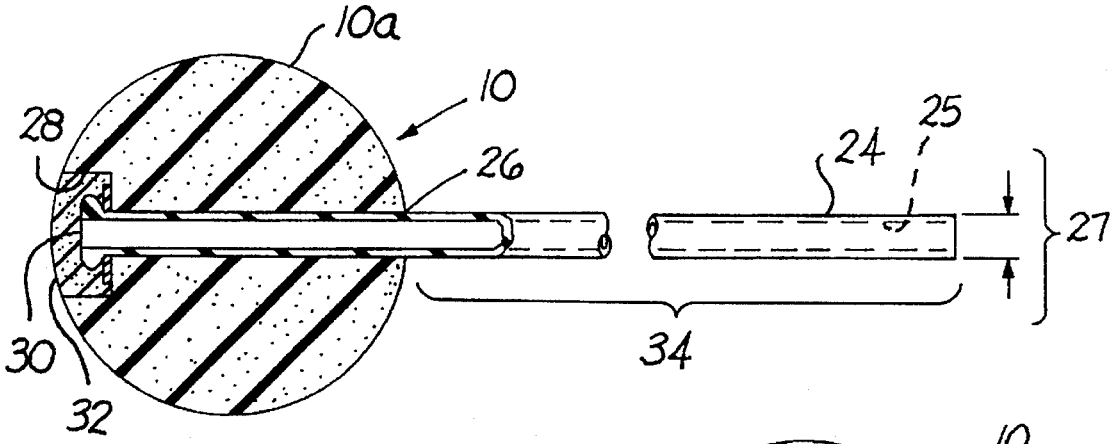
FIG. 4 is a side sectional view of the spherical projectile shown in FIG. 1.
Figure 5:
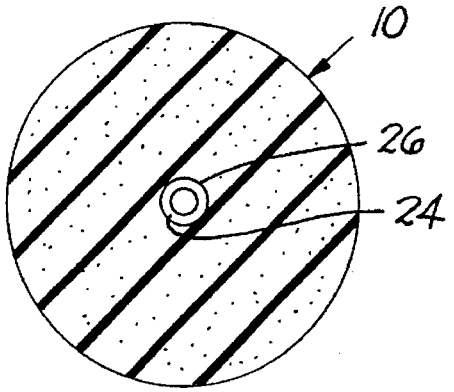
FIG. 5 is a front sectional view of the spherical projectile taken along lines through the center of the projectile.

Referring first to FIGS. 1–5, it may be seen that the projectile toy comprises a spherically shaped projectile 10 and a hand held launcher 12. The projectile 10 is fabricated from a soft, preferably foamed, material such a styrene or polypropylene while launcher 12 may be injection molded and made from a stiffer, more dense thermoplastic material such as a polyolefin. Launcher 12 is provided with a pistol shaped grip 14 along its lower end and has an upper end acting as a launch seat 16. Launch seat 16 has edges 18 tracing a contour, a partially enclosed circle 20 in front section, that substantially conforms to the surface of projectile 10 as best seen in FIGS. 1 and 5. Ribs 22 provide integrity and additional strength to launcher 12.

A tubularly shaped elastic member 24 is attached at one end thereof to the projectile 10. The tubular shape has an inner diameter 25 and an outer diameter 27 as illustrated in FIG. 4. Member 24 extends through the spherical surface 10*a* through a passageway 26 to a small chamber 28 of projectile 10 adjacent the opposite side thereof. End 30 of member 24 has an enlarged diameter that prevents tubular member 24 from being pulled through the projectile 10. A plug 32 of material identical to the material comprising projectile 10 and congruous to the inner dimensions of chamber 28 then is placed into chamber 28 in adherence to projectile 10. The portion 34 of tubular member 24 that extends out of the projectile 10 to be gripped and stretched by the user should be of a length sufficient for the user's hand to get a firm grip thereto. For a purpose described below, a strip 36 of loop and hook fastener material may be adhered to surface 10*a* of projectile 10 and oriented such that the strip is substantially coaxial with the tubular member 24 when extended directly out from the projectile.

There are several characteristics of the tubular member 24 and its relationship to projectile 10 that must be observed in order for the toy to perform satisfactorily. First, and in contrast to most prior art projectile devices, the elastomeric member 24 is located behind the projectile 10. In other words, the member 24 is positioned on the side opposite to the projectile path. Secondly, it has been determined that portion 34 of tubular member 24 should be at least about 4 inches in length to provide for gripping by the user. It has been further noted that where portions 34 extend beyond about 7 inches the projectile cannot be propelled accurately. Thus, portion 34, when not extended, should have a length of about 4 to 7 inches. Additionally, it is important that the tubular member 24 extend through the center of the spherical surface 10*a* and be attached at end 30 nearer the opposite side of the spherical surface 10*a*. Applicant has noted that when the member 24 is attached close to the adjacent side, i.e., between the center and the adjacent side, the projectile does not receive enough energy from the elastic member when stretched and released to move rapidly away once projected. Finally, it is important that the member 24 have a tubular shape as oppose to being solid. Elastic solid members do not perform well as a propelling mechanism. Specifically, applicant has noted that for the toy to perform satisfactorily ratios of the inner diameter to outer diameter equal to or greater than one-half perform should be observed.

Figure 6:
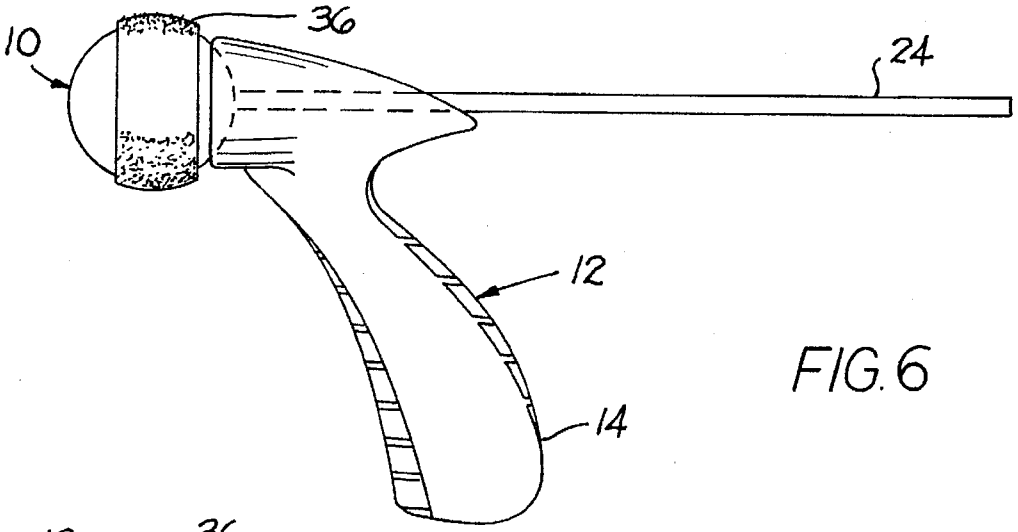
FIG. 6 is a side view of the toy of FIG. 1 prior to the extension of the elastic band attached to the projectile.
Figure 7:
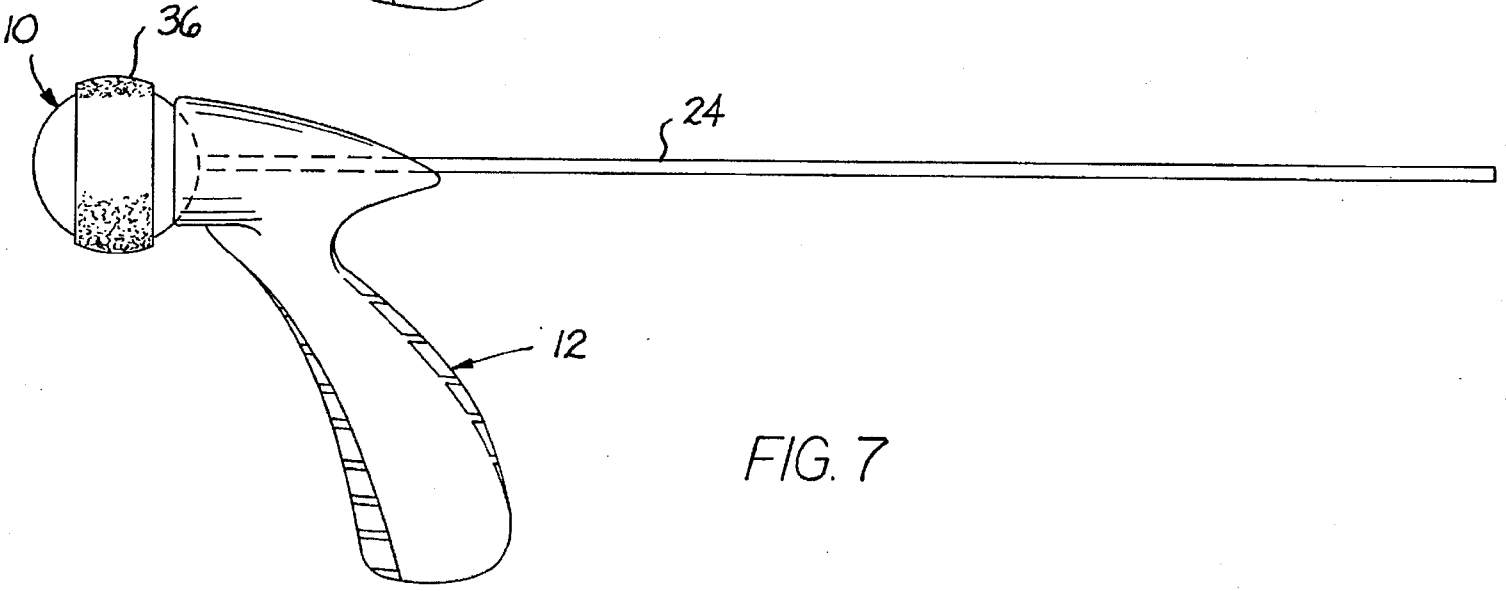
FIG. 7 is a side view of the toy of FIG. 1 illustrating the extension of the elastic band attached to the projectile just before release.
Figure 8:
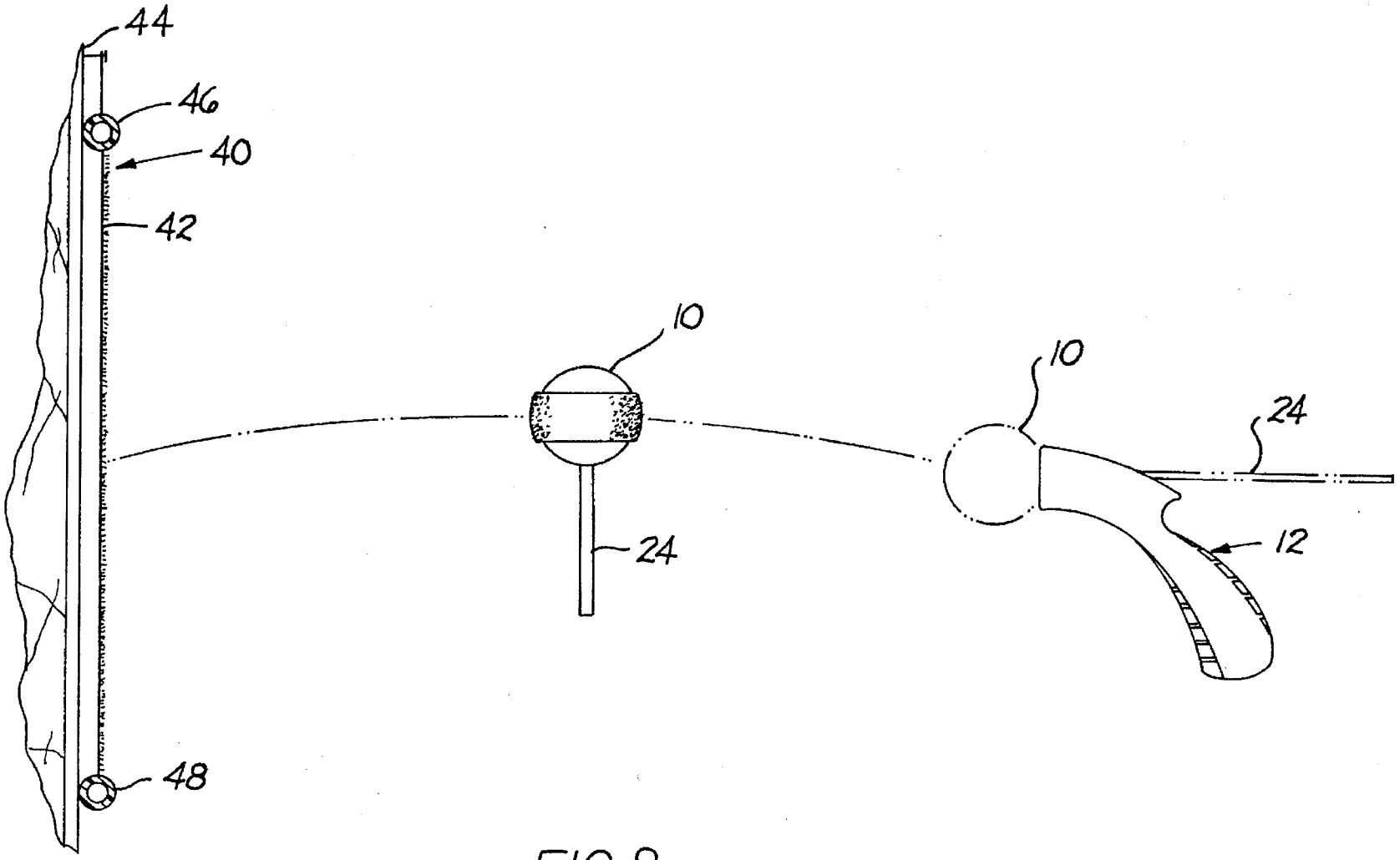
FIG. 8 is side view of the toy showing the path of the projectile toward a target adapted to catch and retain the projectile at the point of impact.

To propel the projectile 10, a user holds the launcher grip 14 with one hand and with the other hand first places the projectile 10 against the mouth edges 18 of seat 16 with the tubular member extending through the opening 20. This position of the projectile 10 against the launcher 12 is illustrated best in FIG. 6. Still holding the launcher 12, the user then grips the portion 34 of tubular member 24 and stretches portion 34 as shown in FIG. 7 and releases portion 34. The trajectory 38 of projectile 24 with member 24 is shown in FIG. 8. It should be noted that the orientation of the projectile 24 is such that the tubular member 24 extends downwardly for a major portion of the trajectory 38. This places the strip 36 at the forward or impact point of the projectile 10.

The projectile 10 in FIG. 8 is following a trajectory 38 that will cause the strip 36 to impact a target structure 40 that has a compatible hook and loop fastener target surface 42. Thus, the reason for the orientation of strip 36 with relationship to the tubular member 24 is evident. Target structure 40 is comprised of a light weight, flexible material that is adapted to be hung on a vertical surface 44 such as wall of a house. A pair of tubularly shaped spacers 46 and 48 extend along the respective upper and lower edges of target structure 40 so that target surface 42 is not in contact with the vertical support surface 44 i.e., is spaced a predetermined distance from the surface 44. The spacing of surface 42 from surface 44 promotes good adherence of the projectile 12 to surface 42 because the material of the target structure can flex upon impact. Applicant has confirmed the need for the spacing by observing that, when the surface 42 is permitted to abut the surface 44, projectiles 10 do not adhere effectively upon impact to the target structure 40 and tend to fall to the floor.

Figure 9:
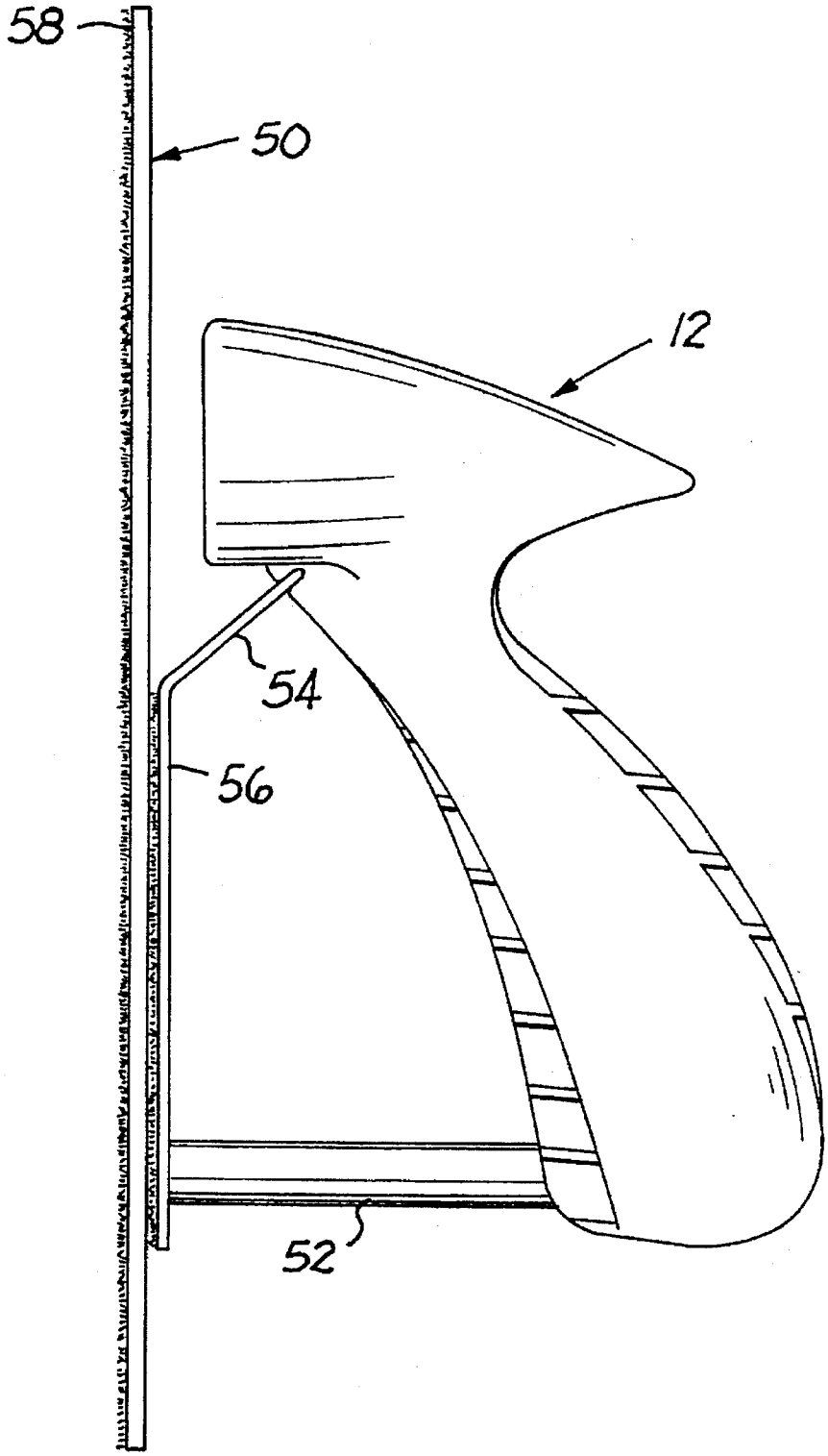
FIG. 9 is a side view of a toy in accordance with another embodiment of the present invention in which a target shield attached to the toy launcher is capable of catching a projectile launched from another launcher.
Figure 10:
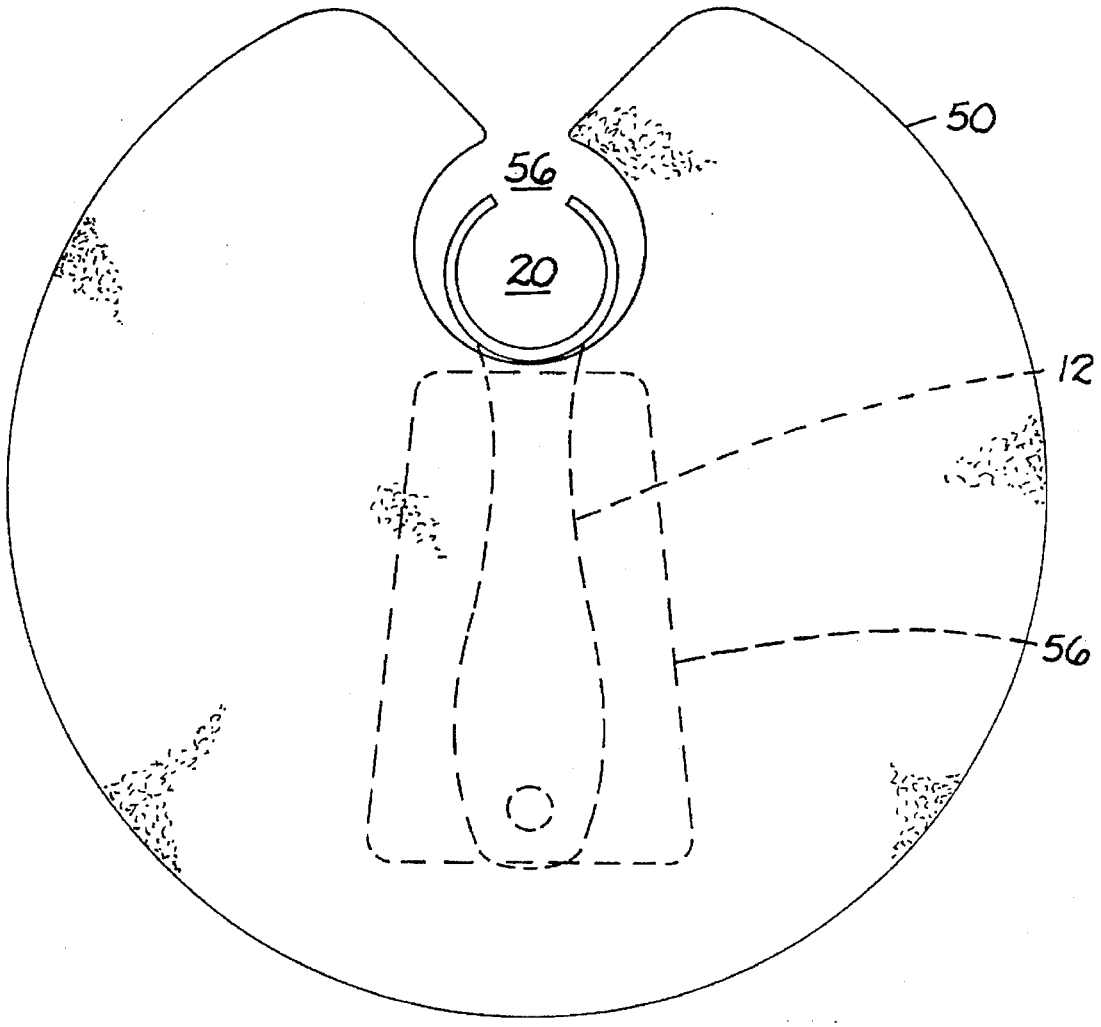
FIG. 10 is a front view of the toy of FIG. 9.

Reference is now made to FIGS. 9 and 10 showing a modified launcher 12 mounting a target and shield plate 50 through upper and lower supports 52 and 54 extending from launcher 12 to mounting plate 56 in adherence to the inside surface of plate 50. The outer surface, i.e., the surface of plate 54 facing away from launcher 12, is covered with a loop and hook fastener 58. Plate 50 may be circularly shaped and has an opening 56 positioned in front of opening 20 of the launcher 12. Plate 50 thus permits projectiles 10 to be propelled through opening 60 while simultaneously acting to catch with fastener 58 projectiles launched by other players using similar launchers and target plates.

Figure 13:
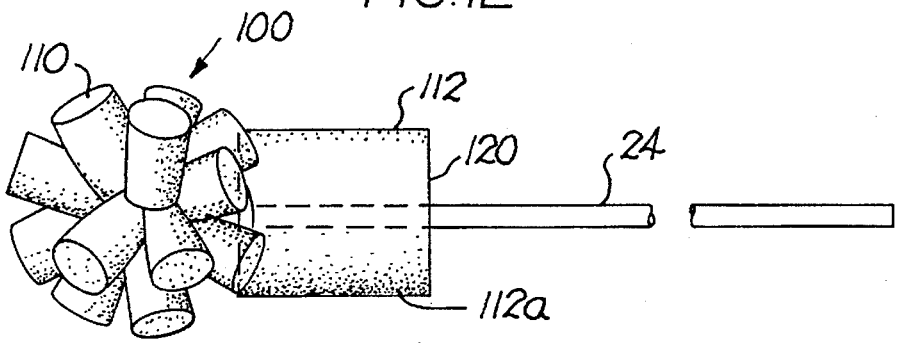
FIG. 13 is a side view of still a further embodiment of the present invention in which the launcher is an annular cylindrical member.
Figure 14:
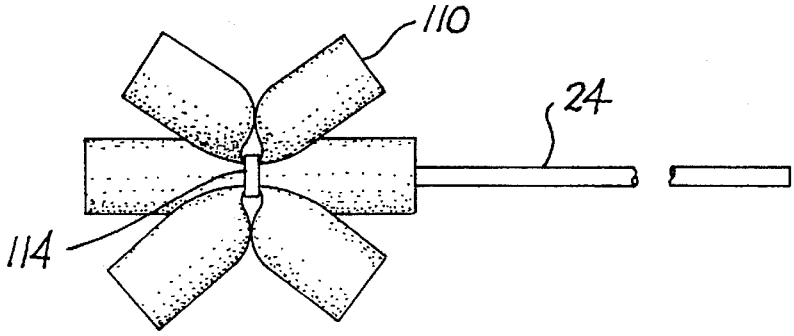
FIG. 14 is a side view of the projectile of FIG. 11 in which certain of the cylindrical objects are removed to show the tying arrangement with the central cylindrical object.

A modified version of the projectile is illustrated in FIGS. 11–14. The projectile depicted by character numeral 100 is comprised of a plurality of cylindrically shaped components 110 tied at the center by a tie 114 to form a body having a substantially spherical surface 100*a* defined by the dashed circle in FIG. 11. The ends of the cylindrical 110 components are essentially tangent to surface 100*a*. As can be seen in FIG. 11, the projectile 100 can be nestled to fit on the upper end of launcher 112 and the tubular member 34 stretched as before to launch the projectile 100. The structure of projectile 100 is best seen in the FIGS. 12 and 14. Tubular member 24 extends through a centrally disposed cylindrical component 110*c* in a manner similar to that described above. Component 110*c* has a coaxially aligned passageway 111 adapted to receive member 24. End 30 of member 24 is enlarged so as to prevent member 24 from being dislodged when portion 34 is stretched during use. A constricting member 113 may be used to further constrict passageway 111 about member 24 near the enlarged end 30. From FIG. 12 it can be seen that the attachment of member 24 to the component 110*c* is beyond the center point of component 110*c* such that when component 110*c* is in place as shown in FIG. 14 the point of attachment will be nearer the opposite side of the spherical surface 100*a* than the adjacent side. As stated above, this positioning of the point of attachment with respect to spherical surface is important for effective propulsion of the projectile.

FIG. 13 also portrays a modified and simpler version of the launcher as annular cylindrically shaped launcher 112. Using this version of a launcher, the user merely grasps the outer surface 112*a* that serves the grip, threads the tubular elastic member 24 through central opening 120 and positions the projectile 112 against the end of launcher 112 and stretches then releases elastic member 34, whereby projectile 112 is launched. Launcher 112, like launcher 12, can be made of any light weight material, preferably stiffer and denser than the material comprising the projectiles.

While the present invention has been described in several embodiment and variations, it is understood that those with ordinary skill in the art will realize that other variations and modifications are possible. Such modifications and variations should be viewed in the spirit and scope of the attached claims as supported by the description and appended drawings.

I claim:

1. A toy for the propelling of soft projectiles using an elastomeric propelling component comprising the combination of a hand held launcher and a projectile object, said projectile including a projectile head of soft material defining a substantially spherical surface and a tubular elastic member of a predetermined length extending through said surface and into said projectile head a distance greater than the radius of said spherical surface, said elastic tubular member being attached at one end to said projectile head with a portion of said elastic tubular member extending away from said projectile head a distance sufficient for a user to grasp and stretch said elastic tubular member away from said attached one end, and said launcher comprising a hand grip and a seat against which said projectile head is positioned, said launcher further defining an opening adjacent said hand grip through which said portion of said elastic tubular member extends.

2. The toy of claim 1 in which said elastic tubular member has a ratio of internal diameter to outer diameter equal to or greater than about ⅓ before being extended.

3. The toy of claim 2 in which said portion of said tubular member is greater than 50% of said predetermined length before being extended.

4. The toy of claim 1 in which said projectile head further comprises a plurality of cylindrically shaped members tied together at the center thereof with the ends of said cylindrically shaped members defining said substantially spherical surface.

5. The toy of claim 4 in which said one end of said tubular elastic member is attached to one of said cylindrically shaped members.

6. The toy of claim 5 in which said tubular elastic member extends through an end of said one cylindrically shaped members.

7. The toy of claim 1 in which said hand held launcher is an annular ring shaped member with said grip being an outside surface thereof, said outside surface having a width sufficient for a hand of a user to grasp said member.

8. The toy of claim 1 in which said grip is a lower end of said launcher in the shape of a pistol grip.

9. The toy of claim 8 in which said projectile head has a first adhering strip attached thereto and said launcher has a projectile catcher attached thereto, said catcher including a surface and a second adhering strip attached to said surface whereby said surface is adapted to catch and retain a projectile impacting thereagainst.

10. The toy of claim 1 further including in the combination thereof a flexible target adapted to be mounted to a wall, said target having a target surface and a first adhering strip attached to said surface, said target further having wall spacing members attached to top and bottom edges thereof to space said target surface from the wall, said projectile head having a second adhering strip attached thereto thereby permitting said target surface to retain said projectile upon impact thereagainst.

11. The toy of claim 10 in which said second strip is mounted about said head such that said strip is substantially coaxially aligned with said tubular member when extending directly away from said projectile head.

* * * * *